United States Patent [19]

Kaaloa

[11] Patent Number: 4,768,742

[45] Date of Patent: Sep. 6, 1988

[54] HANDLER FOR A PLATIC TRASH BAG

[76] Inventor: Edward P. Kaaloa, 98-1233 Pakonane Pl., Honolulu, Hi. 96701

[21] Appl. No.: 17,836

[22] Filed: Feb. 24, 1987

[51] Int. Cl.[4] ..... B65B 67/04

[52] U.S. Cl. ..... 248/99; 248/100

[58] Field of Search ..... 248/99, 100, 95, 101; 403/343, 320; 427/318

[56] References Cited

U.S. PATENT DOCUMENTS

| | | | |
|---|---|---|---|
| 588,455 | 8/1897 | Lofberg et al. | 403/343 X |
| 2,271,167 | 1/1942 | Zachary | 403/343 |
| 2,812,269 | 11/1957 | Ransburg | 427/314 |
| 2,981,639 | 4/1961 | Kachele | 427/314 |
| 3,060,057 | 10/1962 | Johnson | 427/55 |
| 3,180,384 | 4/1965 | Seifert | 248/95 X |
| 3,200,002 | 8/1966 | Lusher | 427/314 |
| 3,747,653 | 7/1973 | Ringer | 248/99 X |
| 3,898,355 | 8/1975 | Okeley et al. | 427/318 X |
| 3,934,631 | 1/1976 | Wilson et al. | 248/99 X |
| 4,023,842 | 5/1977 | Harvey | 248/99 X |
| 4,182,782 | 1/1980 | Scheiber | 427/318 X |
| 4,196,880 | 4/1980 | Hynes | 248/99 |
| 4,318,521 | 3/1982 | Martin et al. | 248/95 X |
| 4,615,743 | 10/1986 | Bylenga | 248/99 X |

*Primary Examiner*—Ramon O. Ramirez

*Attorney, Agent, or Firm*—Martin E. Hsia

[57] ABSTRACT

A handler for a plastic trash bag can comprising a substantially planar, rectangular frame of pencil steel with a plastisol coating deposited thereon.

10 Claims, 1 Drawing Sheet

HANDLER FOR A PLATIC TRASH BAG

BACKGROUND OF THE INVENTION

1. Field of the Invention

This invention relates to the use of plastic trash bags for collecting and discarding leaves, grass trimmings and other lawn debris, and also for collecting and discarding trash.

Large plastic bags are used on a very wide scale by homeowners for the collection and disposal of lawn debris. Large plastic bags also have become widely used for lining trash containers and for otherwise disposing of trash.

A disadvantage of these large plastic bags is that they are not rigid and therefore it is necessary to support the opening of the bag in order to deposit trash and lawn debris in the bag. This support is provided by the trash container when trash bags are used for lining trash containers. In disposing of lawn debris, the bag is usually placed along the ground in a horizontal position and the opening of the bag is opened manually while the lawn debris is raked or otherwise swept into the bag. If trash is to be collected and disposed of at a picnic or other activity for which it would be inconvenient to transport a trash container, a trash bag is either placed on the ground or suspended from a tree, and the bag is opened manually every time trash is to be deposited therein. Trash, lawn debris and other material (whether such material constitutes waste or not) that is to be deposited in a trash bag is herein referred to as "refuse."

2. Background Information

U.S. Pat. No. 3,934,803 issued to Paulus teaches a bag holder comprising a base plate, a blade and a stretcher.

U.S. Pat. No. 4,006,928 issued to Beugin teaches a lawn bag caddy comprising an open wire frame with a stand that is foldable to a substantially flat configuration for convenient storage.

U.S. Pat. No. 4,196,880 issued to Hynes teaches a pair of generally U - shaped frame sections that are telescopically engaged with each other and extended after the open end of a plastic bag is disposed over said members.

U.S. Pat. No. 4,615,743 issued to Bylenga teaches a generally U-shaped member with foreshortened legs, and also teaches the use of a coating comprising particulate material, preferably sand dispersed in a latex base paint or a pad of foam rubber.

DISCLOSURE OF INVENTION

It is an object of this invention to provide a novel trash bag handler which is simple, effective, lightweight and easy to manufacture and store.

It is a further object of this invention to provide an extremely portable, inexpensive and convenient means for using plastic trash bags for collecting and disposing of refuse.

A further object of this invention is to provide a handler for a plastic trash bag that is compact for ease of packaging.

These and other objects are accomplished by a bag handling apparatus comprising a frame with a plastisol coating deposited thereon.

The trash bag is mounted on the frame either by distending the opening of the trash bag over the frame and then pulling the trash bag inside out through the frame, or by inverting the opening of the trash bag, and draping the inverted opening over the exterior of the frame.

The coefficient of friction between the trash bag and the plastisol coating on the frame is so high that, if the trash bag is slightly stretched when mounted on the frame so as to provide a relatively small normal force between the trash bag and the plastisol coating, the trash bag will not slide off the frame unless the trash bag tears.

DESCRIPTION OF THE PREFERRED EMBODIMENT

Figure 1:
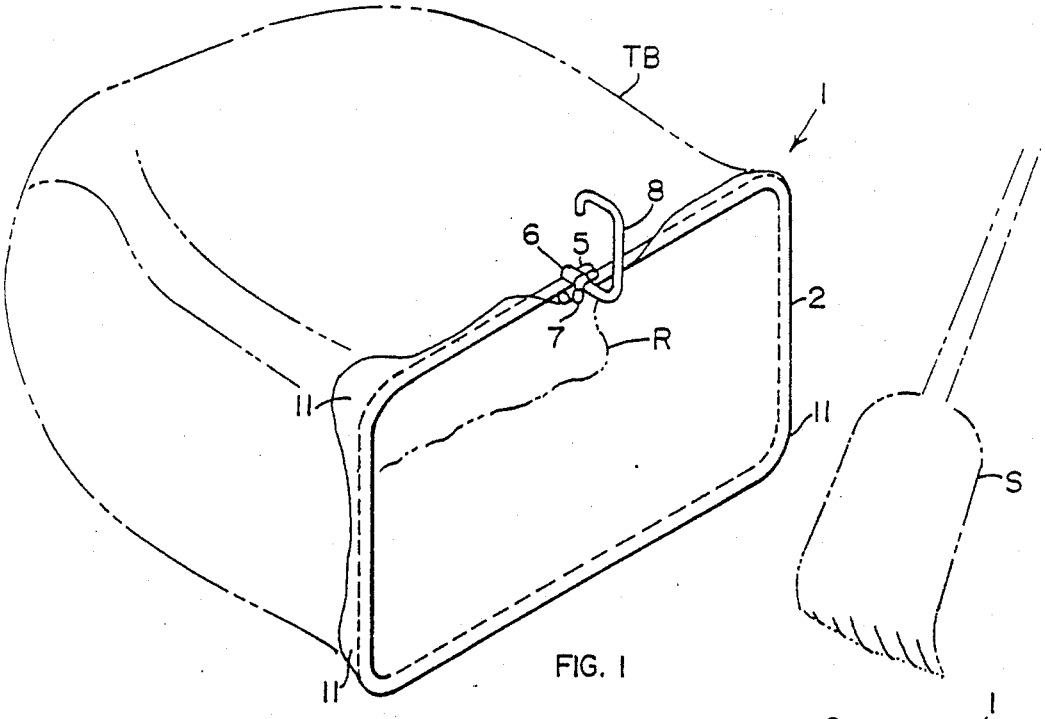
FIG. 1 is a perspective view of the trash bag handler with a trash bag attached.
Figure 2:
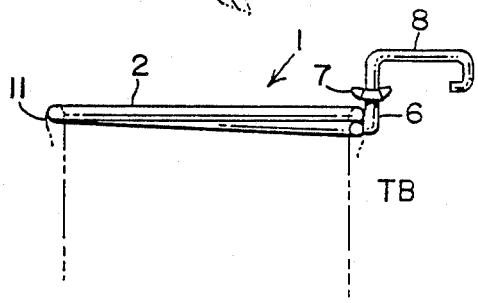
FIG. 2 is a side view of the trash bag handler.
Figure 3:
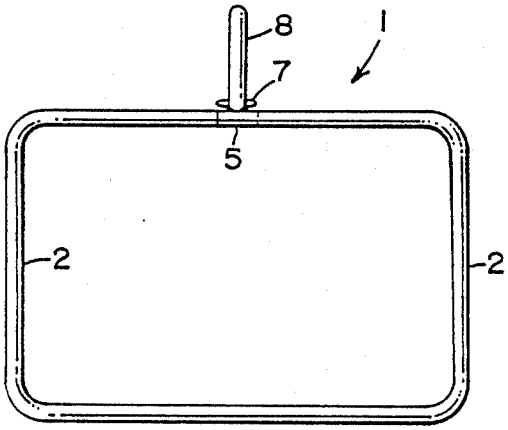
FIG. 3 is a top view of the trash bag handler.
Figure 6:
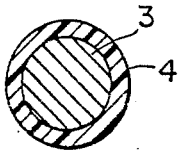
FIG. 6 is an enlarged view along the line 6—6 of FIG. 4 showing the frame and the plastisol coating.
Figure 4:
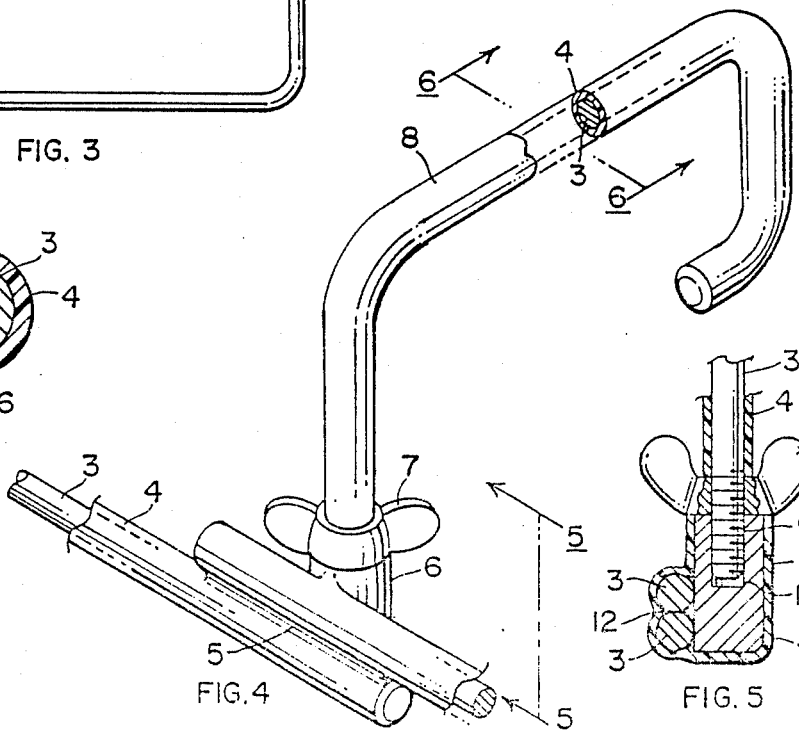
FIG. 4 is an enlarged view of the handler showing detail of the joint.
Figure 5:
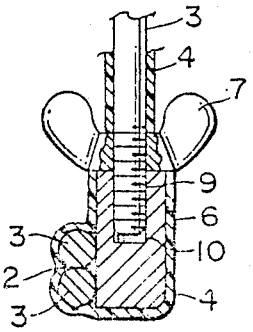
FIG. 5 is a view of the upper right joint section taken along the line 5—5 of FIG. 4.

The handler for a plastic trash bag is shown in FIGS. 1–6 of the drawings. The device 1 comprises a substantially planar frame 2 formed from a pencil steel rod 3 bent into a substantially rectangular shape with an overlap area 5 where the ends of said pencil steel rod 3 overlap. An upright joint 6 having a female thread 10 is welded to said frame 2 perpendicular to the plane of said frame 2 at a weld area 12 within said overlap area 5. A handle 8 having a male thread 9 at one end is threaded through a wing nut 7 and said male thread 9 is threaded into said female thread 10 in said upright joint 6. Said frame 2 and said handle 8 are coated with a plastisol coating 4 deposited thereon.

The opening of a trash bag TB is draped over and through said frame 2 so that said Trash Bag TB is in contact with said plastisol coating 4 deposited on said frame 2 at trash bag gripper areas 11. A broom or other sweeping device S is used to sweep refuse R into said trash bag TB, which is being held open by the device 1.

The frame 2 should be made of a material to which the plastisol coating 4 will adhere with sufficient strength to resist separation of the plastisol coating 4 from the frame 2. The frame 2 also must be sufficiently strong to support the trash bag TB during use and after the trash bag TB has been filled. The frame 2 also should be relatively light for ease of handling. The frame 2 is preferably made of one-quarter inch round pencil steel rod 3 that is bent into the appropriate shape. The preferred shape of the frame 2 is substantially rectangular so that the opening of the trash bag TB can be placed flat against the ground while sweeping. The frame 2 also can be round in applications where the opening of the trash bag TB does not need to be placed against a level surface. The cross section of the pencil steel rod 3 is preferably round so that the greatest surface area of the plastisol coating 4 comes in contact with the trash bag TB. A handle 8 is preferably attached to the frame 2 for ease of handling. The handle 8 is preferably hook shaped to allow use of the device 1 without manually gripping said handle 8. The handle 8 is detachably attached to allow packaging and storage in a substantially flat container. The size of the frame 2 preferably is such that the exterior circumference of the frame 2 and plastisol coating 4 is slightly greater less than the interior circumference of the trash bag TB so that the trash bag TB is slightly stretched when the opening of the trash bag TB is distended over the plastisol coating 4 on the frame 2, thereby forcing the trash bag TB and the plastisol coating 4 into contact and creating a normal force to generate friction between the trash bag TB and the plastisol coating 4.

Plastisol is a dispersion of polyvinyl chloride polymers and copolymers in liquid plasticizers. It comprises a mixture of a resin and a plasticizer that can be molded, cast or made into a continuous film by application of heat. As used in this specification, the term "plastisol" also shall be deemed to include any liquid that can be applied to a frame and cured by any means to form a coating of polyvinyl chloride on said frame, and solid polyvinyl chloride that can be attached to said frame. The liquid plastisol sold by Portland Plastics Co. under the trademark "HD-422" is suitable for use in the practice of this invention. This liquid plastisol has the following characteristics: Brookfield Viscosity at 2 RPM—4800; Brookfield Viscosity at 20 RPM—3600; Severs Viscosity at 40 PSI—20 Poise; Tensile Strength—1,850 PSI; Tear Strength—215 PSI; Elongation—400%; Gel Temperature—180 degrees fahrenheit; Durometer Shore A—5; and Cure Cycle—360 degrees fahrenheit internal temperature.

The plastisol coating is applied to the frame as follows:

1. Heating said frame in an oven for three to four minutes at a temperature between 50 and 500 degrees fahrenheit;

2. Immersing said frame in room temperature liquid plastisol for 25 seconds;

3. Removing said frame from said liquid plastisol and allowing any excess liquid plastisol to run off, thereby leaving a coating of liquid plastisol on said frame; and 4. Heating said frame and said coating of liquid plastisol for 20 seconds at 400 degrees fahrenheit.

The above procedure should be varied as appropriate for varying formulations of liquid plastisol and this specification is intended to encompass other embodiments of the invention using other liquid plastisol formulations.

This specification also is intended to encompass other embodiments of the invention using solid plastisol that is attached or otherwise fixed to a frame. For example, and not by way of limitation, this specification is intended to encompass plastisol gripping elements that are mechanically attached to the frame. This specification also is intended to encompass other embodiments of the invention in which the coating of liquid plastisol is applied by methods other than immersion, such as by painting or spraying.

The handler for a plastic trash bag of the present invention has been described with respect to the specific embodiment disclosed in the drawings. Other embodiments will be apparent to those of ordinary skill in the art. Among these embodiments is a handler for a plastic trash bag that comprises a wastebasket with a plastisol coating, a handler for a plastic trash bag that is round, and the use 2of plastisol to increase the coefficient of friction between a plastic trash bag and a handler for a plastic trash bag. Accordingly, no limitation of the scope of the invention is intended by the disclosure of the specific embodiment herein. The scope of the invention is to be determined in accordance with the claims.

I claim:

1. A handler for a plastic trash bag comprising:

a substantially rectangular frame of one quarter inch pencil steel rod with an exterior circumference approximately equal to the interior circumference of said trash bag;

a coating of plastisol deposited on said frame by heating said frame for approximately 3 to 4 minutes at a temperature between approximately 450 and 500 degrees fahrenheit, immersing said frame in liquid plastisol for approximately 25 seconds, removing said frame from said liquid plastisol, allowing any excess liquid plastisol to run off said frame, thereby leaving a coating of liquid plastisol on said frame, and heating said frame and said coating of liquid plastisol for approximately 20 seconds at approximately 400 degrees fahrenheit;

an upright joint having a female thread welded to said frame; and a handle having a male thread complementary to said female thread threadably engaged with said female thread in said upright joint.

2. A handler for a plastic trash bag, comprising:

a frame; and a coating of plastisol deposited on portions of the surface of said frame, wherein said plastisol coating is deposited by heating said frame for approximately three to four minutes at a temperature between approximately 450 and 500 degrees fahrenheit, immersing said frame in liquid plastisol for approximately 25 seconds, removing said frame from said liquid plastisol, allowing any excess liquid plastisol to run off said frame, thereby leaving a coating of liquid plastisol on said frame, and heating said frame and said coating of liquid plastisol for approximately 20 seconds at approximately 400 degrees fahrenheit.

3. A handler for a plastic trash bag, as described in claim 2, wherein said frame is substantially planar.

4. A handler for a plastic trash bag, as described in claim 3, wherein the exterior circumference of said frame and said plastisol coating is approximately equal to the interior circumference of said trash bag.

5. A handler for a plastic trash bag, as described in claim 4, wherein said frame is substantially rectangular in shape.

6. A handler for a plastic trash bag, as described in claim 5, wherein said frame comprises pencil steel bent into the shape of the frame.

7. A handler for a plastic trash bag, as described in claim 6, further comprising a handle and means for detachably attaching said handle to said frame.

8. A handler for a plastic trash bag, as described in claim 7, wherein said means for detachably attaching said handle to said frame comprises an upright joint having a female thread welded to said frame, and a handle having a male thread complementary to said female thread threadably engaged with said female thread in said upright joint.

9. A handler for a plastic trash bag, as described in claim 8, wherein said handle comprises a hook shaped member.

10. A process for increasing the coefficient of friction between a plastic trash bag and the frame of a handler for a plastic trash bag, comprising the step of depositing a coating of plastisol on the frame of said handler for a plastic trash bag, wherein said depositing step comprises heating said frame for approximately three to four minutes at a temperature between approximately 450 and 500 degrees fahrenheit, immersing said frame in liquid plastisol for approximately 25 seconds, removing said frame from said liquid plastisol, allowing any excess liquid plastisol to run off said frame, thereby leaving a coating of liquid plastisol on said frame, and heating said frame and said coating of liquid plastisol for approximately 20 seconds at approximately 400 degrees fahrenheit.

* * * * *